United States Patent [19]

Liss

[11] Patent Number: 5,018,728

[45] Date of Patent: May 28, 1991

[54] NAME FORMING GAME APPARATUS AND METHOD

[76] Inventor: Jonathan H. Liss, 235 Nevada Ave. S., Golden Valley, Minn. 55426

[21] Appl. No.: 414,194

[22] Filed: Sep. 28, 1989

[51] Int. Cl.[5] ..... H63F 3/00

[52] U.S. Cl. ..... 273/459; 273/272; 434/175

[58] Field of Search ..... 273/272, 299, 241, 240, 273/1 R; 434/172, 175

[56] References Cited

U.S. PATENT DOCUMENTS

| | | | |
|---|---|---|---|
| 1,286,157 | 11/1918 | Vizcarra . | |
| 2,974,433 | 3/1961 | Litzinger | 273/272 X |
| 3,030,112 | 4/1962 | Scharp | 273/136 |
| 3,377,071 | 4/1968 | Treinis | 434/172 X |
| 3,514,876 | 6/1970 | Sellers | 434/175 X |
| 3,836,150 | 9/1974 | Forgrave | 434/172 X |
| 3,947,036 | 3/1976 | Kupec | 434/172 X |
| 4,209,173 | 6/1980 | Curtis et al. | 273/272 X |
| 4,222,561 | 9/1980 | Whitten | 273/1 R |
| 4,227,697 | 10/1980 | Castanis | 273/272 |
| 4,340,231 | 7/1982 | Cammarata | 273/243 |
| 4,360,347 | 11/1982 | Ghaznavi | 434/198 |
| 4,690,409 | 9/1987 | Scalia | 273/299 |
| 4,900,031 | 2/1990 | Wohl | 273/272 X |
| 4,928,976 | 5/1990 | Vano et al. | 273/272 X |

FOREIGN PATENT DOCUMENTS

| | | | |
|---|---|---|---|
| 434904 | 9/1935 | United Kingdom | 434/172 |

*Primary Examiner*—Edward M. Coven
*Assistant Examiner*—William E. Stoll
*Attorney, Agent, or Firm*—Merchant, Gould, Smith, Edell, Welter & Schmidt

[57] ABSTRACT

A game apparatus 10 for forming initial couplets for use in a game wherein players associate names of individuals with such initial couplets. Apparatus 10 provides for set selection disks 23 in connection with indicator 24 to distinguish sets of individuals from the larger set or pool of all individuals whose names satisfy the criteria of the initial couplets. The initial couplet strips 20 are slideably inserted into channels 21 formed in game board 11. Disks 23 are concentrically mounted with one another and are rotatably mounted on game board 11. Game board 11 further includes a hinged prop 12 and score card holder channel 31. Additionally, slots 17 are provided to hold strips 20 not currently in use, with scalloped edges 17 providing for easy insertion and removal of strips 20 into slots 21 and 17.

12 Claims, 2 Drawing Sheets

FIG. 1
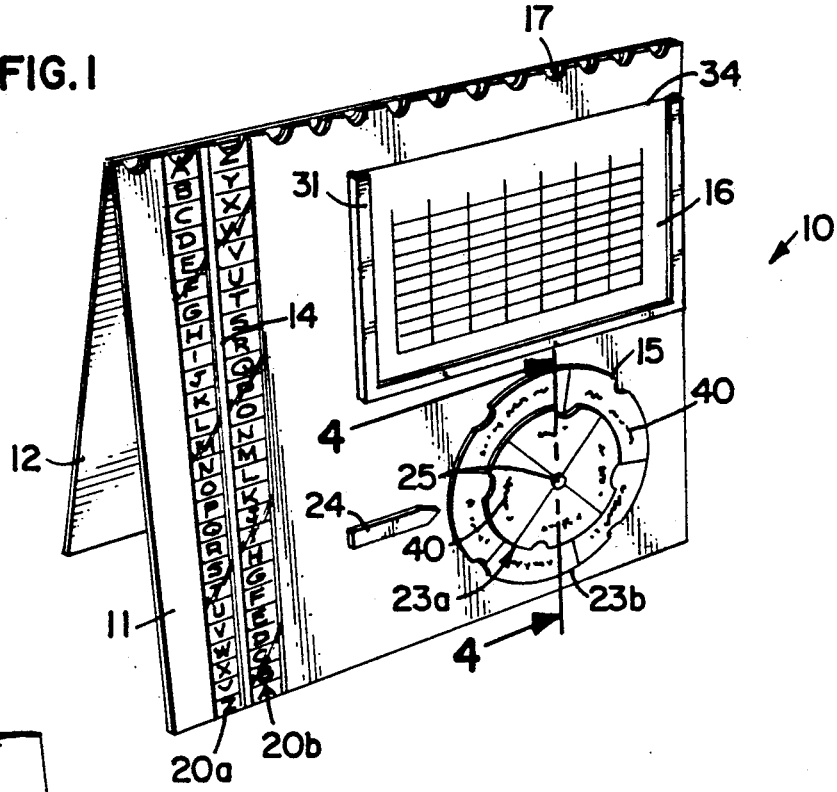
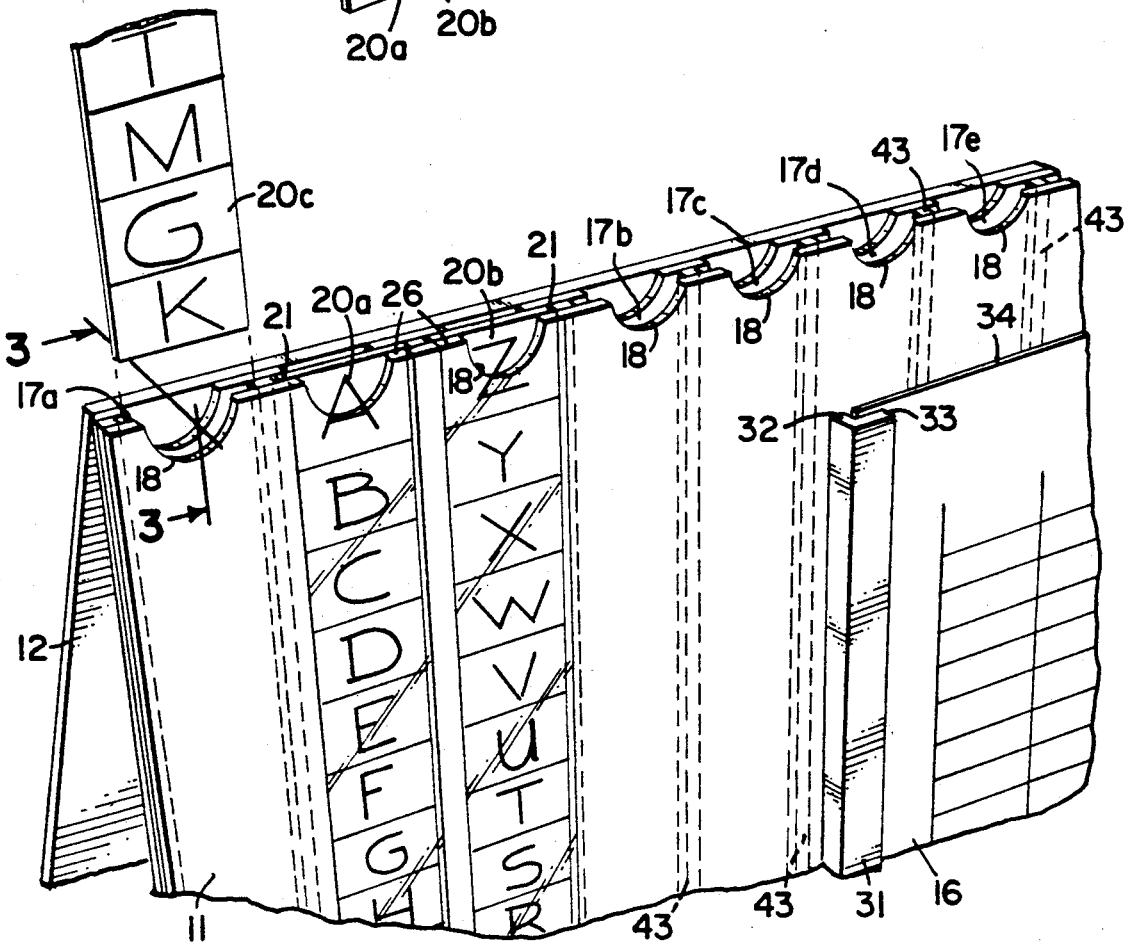
FIG. 2

NAME FORMING GAME APPARATUS AND METHOD

FIELD OF THE INVENTION

This invention relates generally to a game, and more specifically to a game utilizing combinations of letters to form initials for subsequently associating individuals having names corresponding with such initials.

BACKGROUND OF THE INVENTION

Fundamental associative skills are the subject of numerous games and game devices. For example, the card game often referred to as "concentration" typically employs recalling information on one side of an object; the information being normally covered and being only briefly disclosed to a player. The player must then recall and associate the information with a particular object so as to form pairs of objects having similar information.

Another game of this type employs combinations of letters which serves to form initials of individual's names. Typically, the game is played by arranging the alphabet in a first column and then writing a random phrase in a second column next to the alphabet column. In this manner, first and last initials are associated in couplets with one another. Players then attempt to associate names of individuals with the initial couplets. The player who is able to associate the greatest number of names is the winner of that round of the game. The game is fun and entertaining as well as being quite challenging and educational.

A drawback of this letter game, however, is that as the game is played repeatedly, players develop a certain familiarity with particular initial couplets and corresponding name associations. This causes a certain degree of repetitiveness to the game as players develop a rote-type association, rather than a creative association to initial couplets. Therefore, there exists a need for an apparatus for selectively arbitrarily creating couplets of initials and dividing the overall set or pool comprised of names of individuals into sets and/or subsets of names which may be utilized in the game.

There have been several devices in which a user manipulates slides so as to selectively and/or randomly choose letters, however most did so to form words. Examples of these devices are U.S. Pat. Nos.: 1,286,157, issued to Vizcarra; 2,974,433, issued to Litzinger; 3,947,036, issued to Kupec; and 4,227,697, issued to Castanis. In each of these devices the object, to some degree, was to form words, rather than initial couplets. Further, the letters of these devices are typically arranged on slides, wherein the user views an individual letter on a slide through an aperture. Therefore, these devices are overly complex and not suited to display, as a column, an entire series of initial couplets.

Another device, disclosed in U.S. Pat. No. 4,340,231, issued to Cammarata, illustrates the use of sets of letters which, in combination with dice and marker means, forms a plurality of letters from which words are formed. The drawback of using such an apparatus for forming columns of initial couplets, however, is that the letter sets are fixed, and that the means for choosing the sets of letters are overly complex.

Therefore, there arises a need for an apparatus which selectively and effectively forms columns of initial couplets for use in a game wherein players associate names of individuals with such initial couplets. Further, such apparatus should provide means for distinguishing sets and/or subsets of individuals from the larger set or pool of all individuals whose names may satisfy the criteria of the initial couplet.

SUMMARY OF THE INVENTION

In the present invention, there is provided an apparatus which selectively and arbitrarily provides letter couplet indicia comprising means for establishing random couplets of letters for association with initials of individuals names. Further, there is provided set and/or subset selection means for narrowing the pool of individuals whose names satisfy the initials formed by the initial couplets.

In a preferred embodiment apparatus constructed according to the principles of the present invention. Groups of letters are provided, wherein the letters are arranged sequentially in a column on letter carrying strips. Two strips arranged side-by-side thereby form initial couplets, wherein individual letters of one strip are aligned and associated with individual letters of the second strip. Preferably, the strips may be cooperatively attached to a game board.

Also included in the preferred embodiment are subset selection means, preferably comprising "spinner" devices cooperatively attached to the game board. Preferably a plurality of spinner devices are utilized, wherein the spinner devices are disk shaped having an axis of rotation at their approximate center. The disks have varying radii and are cooperatively attached to the game board concentrically with one another. Indicator means are provided adjacent to the spinner devices. Each disk is divided into zones along the spinners circumference, such that the indicator means points to a point along the disk circumference which corresponds to a zone. In this manner, sets and subsets of individuals are created. The spinner devices are individually spinnable so as to randomly select various sets and subsets of individuals.

Other features of a preferred game board include letter indicia storage means to store letter holding strips not being presently utilized, score card holder means for displaying the game status/situation, and a stand to prop the game board at an angle in relation to the surface on which the game board is resting.

Therefore, according to one aspect of the invention, there is provided a word game utilizing a letter couplet, the letter couplet forming initials which are associated with individuals having names comprised of the initials comprising:

(a) a game board;

(b) letter indicia means, cooperatively attached to said game board, for forming a letter couplet; and (c) set means, cooperatively connected to said game board, for distinguishing sets of individuals having names comprised of initials associated with said letter couplet, whereby individuals not a part of the set are not properly associated with said letter couplet.

These and other advantages and features which characterize the present invention are pointed out with particularity in the claims annexed hereto and forming a further part hereof. However, for a better understanding of the invention, its advantages and objects obtained by its use, reference should be made to the Drawing which forms a further part hereof and to the accompanying descriptive matter, in which there is illustrated and described a preferred embodiment of the present invention.

BRIEF DESCRIPTION OF THE DRAWING

In the Drawing wherein like reference numerals and letters indicate corresponding elements throughout the several views:

FIG. 1 is a perspective view of a preferred embodiment game board apparatus constructed according to the principles of the present invention;

FIG. 2 is an enlarged perspective view of a portion of the game board apparatus of FIG. 1 with letter indicia means illustrated in phantom line;

DETAILED DESCRIPTION

The principles of this invention apply particularly well to its application to a word game wherein players associate names of individuals with initial couplets. An example of a preferred embodiment of a game constructed according to the principles of the present invention is illustrated in FIG. 1. The game apparatus is shown generally at 10. Apparatus 10 is comprised of game board 11. Game board 11 is generally rectangular and planar. It should be noted however that other configurations of game board 11 are well within the scope and knowledge of those skilled in the art. Game board 11 is constructed in a durable and ergonomic manner. Preferably game board 11 is made of a high impact plastic such as polypropylene, nylon, high impact styrene and the like. However, those skilled in the art will recognize that other materials such as cardboard and wood, among others, might also be utilized.

Figure 3:
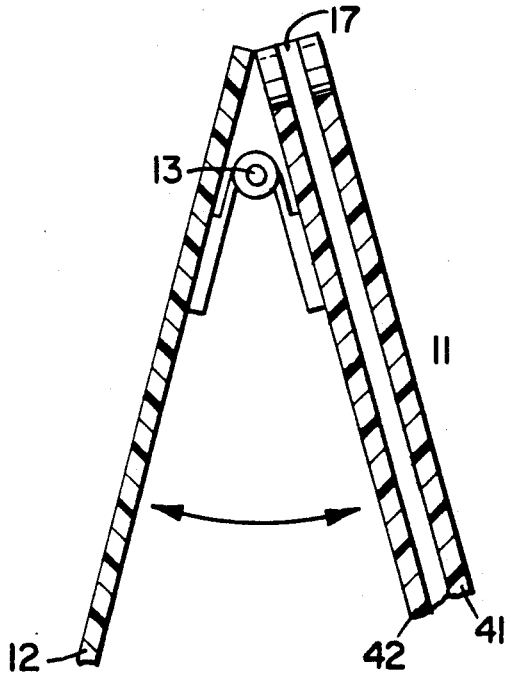
FIG. 3 is a cross sectional view of the game board apparatus of FIG. 1 taken through the line 3—3 of FIG. 2.

Game board 11 includes game board prop 12, which is cooperatively connected to game board 11 by a hinge 13 (best seen in FIG. 3). Prop 12 allows game board 11 to reside, during operation, at an angle relative to the surface on which game board 11 is resting, rather than flat on the surface. Those skilled in the art will recognize that the mean plane defined by game board 11 forms an angle with the mean plane formed by the surface (e.g., a table or floor) on which game board 11 rests.

When not in use, prop 12 may be folded flush with game board 11 to allow for easy storage. Also, some players may prefer to utilize game board 11 in a horizontal position while in operation (i.e., resting on its back such that the mean plane formed by game board 11 is generally horizontal). In the preferred embodiment, when prop 12 is extended, game board 11 is aligned at an angle which is nearly vertical (i.e., the mean plane formed by game board 11 is approximately normal to the surface on which game board 11 rests), however, any other number of angles or positions may be utilized.

Game board 11 further includes letter indicia means 14, set selection means 15, score card holder means 16, and letter strip holder means 17. Each of these elements will be discussed further below, with a discussion of the operation of game 10 deferred pending a discussion of the foregoing elements.

Referring to FIGS. 1 and 2, letter indicia means 14 are comprised of letter carrying strips 20. Preferably strips 20 are made of a stiff paper or cardboard wherein handling of the strips by players tends not to bend, mutilate or otherwise fold the strips 20. Other materials, such as metals and plastics may also be utilized. Further, the strips 20 must withstand insertion into slots 21 (described below).

Letters on the strips 20 are arranged sequentially in column form. The alphabet and reverse alphabet are shown on strips 20*a* and 20*b* respectfully, solely for the purpose of illustration. Any combination and arrangement of letters may be utilized on strips 20. Preferably a plurality of strips 20 are provided with game 10 to provide the maximum number of initial couplets. Since the theoretical number of possible combinations of letters for each initial couplet is 262 (i.e., $26 \times 26$) and there are 26 initial couplets in the preferred embodiment, including strips 20 to provide for each possible combination, although preferred, is not practical. Therefore, enough strips 20 are provided to introduce an element of randomness to the selected initial couplets. To further alleviate the number of strips required, preferably letters may be printed on both sides of the strips 20.

Further, the strips 20 may be numbered to correspond with a particular storage slot 17*a*–17*j*, with each strip 20 stored within a particular slot 17*a*–17*j* receiving a separate designation (i.e., a-1, a-2, a-3, etc. . . . ; b-1, b-2, b-3, etc. . . . ; etc.). In this manner the first and second strips 20 which are chosen for any particular round may be recorded to avoid duplication of initial couplets formed.

As noted previously, letter strips 20 are arranged and configured so as to be slideably inserted into a channel or slot 21 formed in game board 11. Preferably the slot 21 has a clear plastic covering 26, cooperatively connected to game board 11 and which preferably defines a portion of slot 21, through which players may view the letters carried by letter strips 20.

Set selector means 15 is comprised of a plurality of concentrically arranged disks 23 and indicator device 24. The set selector means 15 are rotatable about a center axis 25 and include zones 40 having designations which form sets from the pool of individuals whose names satisfy the initial couplets. By utilizing more than one disk 23, subsets may be made from the sets, with each subset created introducing a further level of difficulty when attempting to associate individuals' names with initial couplets. An example of designations which may be included in zones 40 of set selector means 15 follows:

TABLE 1

| | Disk 1 | Disk 2 |
|---|---|---|
| Zone 1 | Male | Sports |
| Zone 2 | Female | Science |
| Zone 3 | Living | Arts |
| Zone 4 | Dead | Politics |

Figure 4:
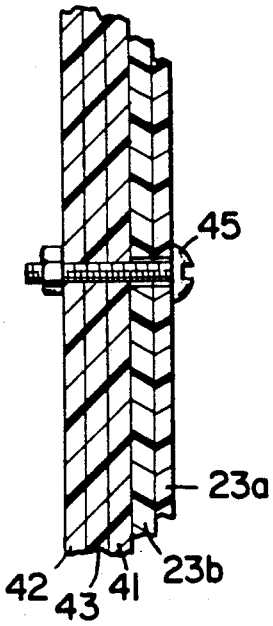
FIG. 4 is a cross sectional view of a portion of the game board apparatus of FIG. 1 taken through line 4—4 of FIG. 1.

As illustrated in FIG. 4, rotatable disks 23 are cooperatively connected to game board 11 through their center axis or axis of rotation 25 by a screw 30. Bushings (not shown) or other well known means allow the disks 23 to readily individually spin about their center axis 25. Those skilled in the art will recognize that any other number of fastening devices may be utilized so as to rotatably affix disks 23 to game board 11.

Indicator device 24 is stationary and is cooperatively connected to game board 11 to provide a point of reference to choose a zone 40 from disks 23. Indicator 24 serves to select the zone 40 which comes to rest adjacent to indicator 24 (i.e., the angle formed by the zone from the center of rotation 25 to the circumference of the disk 23 includes indicator 24). Indicator means 24 and disks 23 are also preferably made of a high impact plastic.

Although only two disks 23 are illustrated, any number of disks 23 may be utilized, with each disk serving to potentially increase the level of difficulty.

Scorecard holder means 16 is also cooperatively connected to game board 11 and comprises a longitudinally U-shaped member 31. Member 31 is transversely L-shaped (i.e., the cross-section of member 31 is L-shaped, best seen in FIG. 2) and affixed at the top half 32 of the L to game board 11; the bottom half 33 forming a channel in which a score card 34 is slideably inserted.

Letter strip holding means 17 are also included in game board 11. Strips 20 may be stored in strip holding means 17 when not being used to form initial couplets. Such strip holding means 17 are comprised of slots, similar to slots 21 utilized to form the initial letter couplets, but which have an opaque covering. Scalloped portions 18 are utilized so as to provide for easy removal of letter strips 20.

Preferably the strip holding means 17 and slots 21 are formed by the top 41 of game board 11 and bottom 42 of game board 11, with connector members 43 sandwiched between top 41 and bottom. The strip holding means 17 and slots 21 are arranged and configured to hold strips 20.

In operation, two letter strips 20 are chosen from letter strip storage departments 17 by a player. Preferably the player is chosen at random or by some other equitable method (i.e., the player who's first letter in the player's last name which is closest to the end of the alphabet draws first). For each round of the game, the game proceeds by revolving clockwise, taking turns sequentially.

The player who picks the strips 20 slides them into the letter indicia slots 21 in the order in which the strips 20 are chosen. The letters face the front of game board 11 so as to be visible through the clear covering 26. The established letter couplets may then be written down by each player on a game sheet (not shown).

Next, the first disk 23*a* is spun so as to choose a first set. Second disk 23*b* is then also spun so as to choose a second set, the second set defining a subset of the first set. Additionally, blank wheels may be provided so that players may choose their own categories (i.e., baseball, biology, etc.) or each player or team may choose a category.

Players then have a specific time period in which to associate individuals whose names satisfy both the criteria designated by the initial couplets and subsets determined by the set selection means 15. Scoring may be provided for each correct answer or may be scored to grant additional points if the answer falls within the set or subset provided by the subset selector means 15. By way of example, if the established sets were "dead" and "politics" and an initial couplet was B-F, then the name Benjamin Franklin would be properly associated with the initial couplet.

It is to be understood that even though numerous characteristics and advantages of the present invention have been set forth in the foregoing description, together with details of the structure and function of the invention, the disclosure is illustrative only. Other modifications and alterations are well within the knowledge of those skilled in the art and are to be included within the broad scope of the appended claims.

What is claimed is:

1. A word game apparatus utilizing a letter couplet, wherein players associated corresponding initials formed by names of individuals with the letter couplet, the apparatus comprising:

(a) a game board;

(b) letter indicia means, cooperatively attached to said game board, for forming a letter couplet; and (c) subset means, cooperatively connected to said board game, for distinguishing subsets of individuals having names, wherein only the initials of the names of those individuals which are properly included in the subset and which properly correspond with said letter couplet may be associated by the players.

2. The word game of claim 1, wherein said letter indicia means comprise columns of letters arranged sequentially.

3. The word game of claim 2, further comprising letter indicia holding means, cooperatively connected to said game board, for holding said letter indicia means and wherein said letter indicia means comprise first and second strips having individual letters arranged sequentially, wherein said individual letters on said first strip forms a couplet with a corresponding individual letter on said second strip.

4. The word game of claim 3, wherein said subset means comprise a spinner having an axis of rotation, said spinner cooperatively attached to said game board about said axis, wherein said spinner is rotatable about said axis.

5. The word game of claim 2, wherein said subset means comprise a plurality of spinners, said spinners having an axis of rotation and generally arranged and configured in a disk like fashion, each of said spinners having a different radius from said axis of rotation to the edge of said disk, said spinners arranged in a face to face fashion with one another, wherein disks of relatively smaller radii are placed on top of disks of relatively larger radii, whereby each disk is individually rotatable and selects a different subset.

6. The word game of claim 5, further comprising a stand, said stand cooperatively connected to said game board, wherein said stand is arranged and configured to hold said game board in a substantially vertical manner.

7. The word game of claim 6, further comprising score sheet holder means, cooperatively connected to said game board, for holding a score sheet, whereby the progress of the players during the game may be monitored.

8. An apparatus for playing word games including a base having a front and a back cooperatively connected by strips, wherein said front and back are held in a spaced apart relation by said strips, and wherein said strips are spaced apart from one another, wherein channels are formed between said strips and said front and back; letter carrying members cooperatively arranged and configured so as to be slidably insertable into said channels, said letter carrying members forming initials; selector means, cooperatively connected to said base for randomly selecting sets of names of individuals, wherein the initials of the selected names which match the initials formed by said letter carrying members may be properly associated with one another.

9. The apparatus of claim 8, wherein said selector means includes concentrically arranged disks.

10. The apparatus of claim 9, wherein said top of said base includes an aperture through which at least two of said letter carrying members may be viewed.

11. The apparatus of claim 8, wherein said base includes a prop, wherein said base may be arranged and configured at a angle with respect to the surface on which said base is resting.

12. A method for playing a word game, utilizing letter couplets which are used by players in an attempt to associate corresponding initials of names of individuals, comprising the steps of:

(a) selecting letter strips having a sequentially arranged series of letters so as to form letter couplets;

(b) spinning a selector device so as to distinguish subsets of individuals having names; and (c) selecting names of individuals, said names forming initials which correspond with said letter couplets, wherein only those individuals which are properly part of said distinguished subset may be used by the players to correspond with said letter couplets.

* * * * *

UNITED STATES PATENT AND TRADEMARK OFFICE

CERTIFICATE OF CORRECTION

PATENT NO. : 5,018,728

DATED : May 28, 1991

INVENTOR(S) : JONATHAN H. LISS

It is certified that error appears in the above-identified patent and that said Letters Patent is hereby corrected as shown below:

In column 6, line 5, for "associated" read --associate--.

Signed and Sealed this

Twentieth Day of October, 1992

*Attest:*

DOUGLAS B. COMER

*Attesting Officer*

*Acting Commissioner of Patents and Trademarks*